US006336348B1

(12) United States Patent
Lee et al.

(10) Patent No.: US 6,336,348 B1
(45) Date of Patent: Jan. 8, 2002

(54) SENSOR FOR DETECTING BOTH WATER LEVEL AND VIBRATION IN WASHING MACHINE

(75) Inventors: Phal Jin Lee; Seung Jin Jo, both of Kyongsangnam-do; Soung Bong Choi, Pusan-shi; Dong Geun Lee, Kyongsangnam-do, all of (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/512,596

(22) Filed: Feb. 25, 2000

(30) Foreign Application Priority Data

| | | |
|---|---|---|
| Feb. 25, 1999 | (KR) | 99-6296 |
| Jun. 21, 1999 | (KR) | 99-23230 |
| Jun. 21, 1999 | (KR) | 99-23232 |
| Oct. 12, 1999 | (KR) | 99-44107 |

(51) Int. Cl.[7] ..... D06F 33/02

(52) U.S. Cl. ..... 68/12.27; 68/12.21; 68/12.05; 68/23.3

(58) Field of Search ..... 68/12.01, 12.05, 68/12.14, 12.21, 23.1, 23.3, 23.5, 12.27; 8/158, 159

(56) References Cited

U.S. PATENT DOCUMENTS

| | | | | |
|---|---|---|---|---|
| 4,843,671 A | * | 7/1989 | Hirooka et al. | |
| 5,038,587 A | | 8/1991 | Harmelink | 68/12.26 |
| 5,050,407 A | | 9/1991 | Wild | 68/12.06 |
| 5,058,401 A | * | 10/1991 | Nakamura et al. | |
| 5,207,764 A | * | 5/1993 | Akabane et al. | |
| 5,301,522 A | * | 4/1994 | Ikemizu et al. | |
| 5,375,437 A | | 12/1994 | Dausch et al. | 68/12.06 |
| 5,396,413 A | * | 3/1995 | Kaneko et al. | |
| 5,765,402 A | * | 6/1998 | Ikeda et al. | |
| 5,768,730 A | * | 6/1998 | Matsumoto et al. | |
| 5,850,746 A | | 12/1998 | Lee | 68/12.06 |
| 5,946,948 A | * | 9/1999 | Cho | |

* cited by examiner

*Primary Examiner*—Frankie L. Stinson
(74) *Attorney, Agent, or Firm*—Fleshner & Kim, LLP

(57) ABSTRACT

Sensor for detecting both a water level and a vibration in a washing machine, which permits detection both of the water level of washing water in a washing tub and the vibration of the washing tub, including a housing which is a body of the sensor for detecting both the water level and the vibration, hydraulic pressure transmission means under the housing for moving up and down by a hydraulic pressure of the water level in a washing tub, a coil part above the hydraulic pressure transmission means having a coil with a proper inductance, a core holder on the hydraulic pressure transmission means having a core accommodated therein, the core adapted to move up and down within the coil part for varying the inductance of the coil, a cap fitted to a top portion of the coil part, a spring placed in a hollow of the coil part, and a vibration detecting means adapted to move according to the vibration of the housing for varying the inductance of the coil, whereby detecting the water level in the washing tub by substantially varying the inductance of the coil with the up and down movement of the core during a washing cycle or a rinsing cycle, and substantially detecting the vibration of the washing tub by varying the inductance of the coil by means of the vibration detecting means during a spinning cycle.

10 Claims, 16 Drawing Sheets

SENSOR FOR DETECTING BOTH WATER LEVEL AND VIBRATION IN WASHING MACHINE

BACKGROUND OF THE INVENTION

1. Field of the Invention

The present invention relates to a sensor for a washing machine, and more particularly, to a sensor for detecting both a water level and a vibration in a washing machine, which permits detection both of the water level of washing water in a washing tub and the vibration of the washing tub.

2. Background of the Related Art

In general, the washing machine removes contaminant on laundry by conducting a washing, rinsing, spinning cycles in succession. In detail, the washing cycle is a process for separating the contaminant on the laundry by friction between washing water and the laundry caused by water circulation using water circulation producing means, such as a pulsator, and softening action of detergent. And, upon completion of the washing cycle, the rinsing cycle is conducted, in which contaminated water is discharged to outside of the washing machine, fresh water is supplied to the washing tub, and the pulsator is rotated to rinse the laundry. Upon completion of the rinsing cycle, the spinning cycle is started. That is, a motor is rotated at a high speed, to discharge water remained in the laundry to outside of the washing tub by using a centrifugal force.

In the meantime, a water level in the washing tub, quantity of detergent to be used, and a total washing time period are determined in general with reference to an amount of laundry introduced in the washing tub in the conduction of the washing cycle. Once an appropriate water level is determined with reference to the amount of laundry, the washing water is supplied to the washing tub until the washing water reaches to the set water level before the washing cycle or the rinsing cycle is started. In this instance, the water level in the washing tub is detected by means of a water level sensor.

In the meantime, it is unavoidable that vibration and noise are occurred in the spinning cycle as the washing tub spins at a high speed ranging around 1700 rpm. Therefore, in order to attenuate the vibration, vibration attenuation means, such as snubber bar, is provided between the washing tub and the washing machine case. However, in fact it is impossible to absorb the entire vibration generated in the high speed rotation by means of the vibration attenuation means. Therefore, recently, a vibration detection sensor is used for detecting the vibration of the washing tub generated during the spinning cycle, for controlling processing of the spinning cycle according to a degree of the vibration. A related art water level detecting sensor and a related art vibration detecting sensor will be explained.

First, a related art washing machine and a water level detecting sensor will be explained with reference to FIG. 1 and 2. There is an outer tub 5 inside of a washing machine case 1, a washing and spinning tub(hereafter called as "washing tub") 3 rotatably mounted in the outer tub 5, and a pulsator inside of the washing tub 3 rotated by a motor 9. And, there is a snubber bar 6 for attenuating the vibration between the outer tub 5 and the case 1. And, there is a feed water valve 7 above the washing machine case 1, and a drain valve 8 connected to the outer tub 5. There are a water level detecting sensor 10 and a vibration detecting sensor 20 on an upper portion of the washing machine case 1.

The water level detecting sensor will be explained in detail with reference to FIGS. 2A, 2B and 3.

The water level detecting sensor 10 is provided with a hydraulic pressure transmission means, such as bellows 12 and diaphragm 12*a*, in a lower portion of a cylindrical housing 11, a body of the water level detecting sensor 10, for expanding and contracting in up and down direction on reception of a hydraulic pressure generated by the water level of the washing tub. That is, there is a hydraulic pressure transmission passage 5*a* formed between the hydraulic pressure transmission means and the outer tub 5, for converting the water level of the washing tub and transmitting to the hydraulic pressure transmission means. There is a coil part 15 having a coil with an inductance on an inside wall of the housing 11, and a core holder 13 under the coil part 15 for accommodating a core 14 which moves in an inside space of the coil part 15 in an up and down direction for varying the inductance of the coil 15*a*. And, there is a cap 18 over the coil part 15, and a spring 16 between the cap 18 and the core 14. That is, when the bellows 12 expands or contracts, the core 14 and the core holder 13, interlocked with a movement of the bellows 12, move within a hollow of the coil part 15 in an up and down direction, with the inductance of the coil 15*a* varied.

The operation principle of the water level detecting sensor will be explained.

The coil 15*a* of the coil part 15 is connected to an LC resonance circuit 10*a*, an output terminal of which is connected to a microprocessor 2. The microprocessor 2 controls the feed water valve 7 and the drain valve 8 with reference to a water level the water level detecting sensor senses. In the washing cycle, the water level is fixed according to an amount of the laundry, and the feed water valve 7 is opened to supply water to the washing tub 3. During water is supplied to the washing tub 3, a hydraulic pressure for the water level is transmitted to the hydraulic pressure transmission means, such as the diaphragm 12*a*, through the hydraulic pressure transmission passage 5*a*, to cause the diaphragm 12*a* to expand or contract in proportion to the transmitted hydraulic pressure. That is, as water is supplied to the washing tub 3, the diaphragm overcomes an elastic force of the spring 16 to expand upward, along with the core 14 on the core holder 13 through the hollow in the coil part 15. Then, the movement of the core 14 varies the inductance of the coil 15*a*, and the inductance variation of the coil 15*a* is converted into a predetermined resonance frequency at the LC resonance circuit 10*a*. The microprocessor 2 determines the water level in the washing tub with reference to a variation of the resonance frequency. When the measured water level reaches to a preset water level, the feed water valve 7 is closed, to stop water supply, and the motor is put into operation for conducting the washing cycle.

In the meantime, upon completion of the washing cycle, contaminated water in the washing tub is drained, and completion of the drain is also detected by using the water level detecting sensor 10. That is, as the drain proceeds, the water level in the washing tub drops, to permit the diaphragm 12*a* to return to an initial position by the elastic force of the spring 16. Accordingly, the core holder 13 having the core 14 mounted thereon also moves downward to an initial position. If the core 14 returns to the initial position, the inductance of the coil part 15 is also reduced, and the reduced inductance is converted into a resonance frequency at the LC resonance circuit 10*a*, with reference to which a drain completion time is determined.

A related art vibration detecting sensor will be explained, with reference to FIGS. 1 and 4. There are one pair of contacts 24 and 25 on the washing machine case 1, and a switch leg 22 rotatably fitted under the contacts 24 and 25 for open or closing the contacts 24 and 25, electrically. And, there are one pair of springs 23 under the switch leg 22.

The operation of the vibration detecting sensor will be explained with reference to FIGS. 3 and 4. During washing, particularly, during spinning, if the washing tub hits the switch leg 22 of the vibration detecting sensor 20 due to severe vibration of the washing tub, the switch leg 22 overcomes the elastic force of the spring 23, and rotates in a counter clockwise direction on the drawing, to short the contacts 24 and 25. Upon occurrence of an electrical signal at any one of the pair of the contacts 24 and 25, the microprocessor 2 determines that there is a vibration occurred. According to this, the drain valve 7 is opened for a preset time period, for supplying water to the washing tub, so that the laundry is disposed, not to one side, but evenly, for reducing the vibration. Once the vibration is reduced, the motor 9 is rotated at a high speed, to process the spinning. If there is the electrical signal occurred at the contacts 24 and 25 even after the vibration reducing process continuously, the motor 9 is stopped, for preventing danger coming from an excessive vibration beforehand.

However, the related art water level detecting sensor and the vibration detecting sensor have the following problems.

First, the use of the individual water level detecting sensor and the vibration detecting sensor causes a production cost high. And, the separate fitting of the two sensors require much assembly man-hour.

Second, the related art vibration detecting sensor has difficulty in fitting, and detecting the vibration accurately in view of the structure. Because, if the switch leg is fitted close to the outer tub, the vibration sensor may detect a slight vibration, to cause unnecessary operation, and if the switch leg is fitted far than required, the vibration sensor can detect the vibration only after the vibration becomes very severe. In order to solve such a problem, an accurate vibration amplitude W of the washing tub should be known, which is impossible in fact. And, even if the switch leg is fitted appropriately, the employment of mechanical contacts and spring in the related art vibration detecting sensor requires to re-adjust a gap between the contacts and the switch leg after a prolonged use of the washing machine, and involved in deterioration of a reliability. Because the contacts may rust, or the elastic force of the spring may degrade from the prolonged use.

SUMMARY OF THE INVENTION

Accordingly, the present invention is directed to a sensor for detecting both a water level and a vibration in a washing machine that substantially obviates one or more of the problems due to limitations and disadvantages of the related art.

An object of the present invention is to provide a sensor for detecting both a water level and a vibration in a washing machine, in which one sensor can detect both a water level and a vibration.

Other object of the present invention is to provide a sensor for detecting both a water level and a vibration in a washing machine , which permits an accurate vibration detection and has a long lifetime.

Another object of the present invention is to provide a sensor for detecting both a water level and a vibration in a washing machine, which can be fitted easily, and permits reduction of a production cost.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the sensor for detecting both a water level and a vibration in a washing machine includes a housing which is a body of the sensor for detecting both the water level and the vibration, hydraulic pressure transmission means under the housing for moving up and down by a hydraulic pressure of the water level in a washing tub, a coil part above the hydraulic pressure transmission means having a coil with a proper inductance, a core holder on the hydraulic pressure transmission means having a core accommodated therein, the core adapted to move up and down within the coil part for varying the inductance of the coil, a cap fitted to a top portion of the coil part, a spring placed in a hollow of the coil part, and a vibration detecting means adapted to move according to the vibration of the housing for varying the inductance of the coil, whereby detecting the water level in the washing tub by substantially varying the inductance of the coil with the up and down movement of the core during a washing cycle or a rinsing cycle, and substantially detecting the vibration of the washing tub by varying the inductance of the coil by means of the vibration detecting means during a spinning cycle.

The vibration detecting means includes a rolling body for substantially moving up and down interlocked with the vibration of the washing tub for varying the inductance of the coil, and a rolling body supporting member having a sloped surface with an angle for accommodating the rolling body.

And, preferably, the rolling body supporting member includes an inserting member on a bottom, and the core holder includes a coupling member for mechanically inserting and coupling the inserting member thereto.

And, preferably, the slope surface of the rolling body supporting member includes a barring surface substantially vertical to the slope surface for inhibiting movement of the rolling body for a minute vibration Accordingly, the sensor for detecting both a water level and a vibration in a washing machine of the present invention permits detection of both the water level and the vibration by means of one sensor, and the sensor also permits an accurate detection of the vibration.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings. Components of the present invention identical to the same of the related art will be given the same reference symbols, and explanations for the same will be omitted. Though a structure of the related art water level detecting sensor is used, the present invention suggests to provide means(hereafter called as "vibration detecting means") for varying an inductance of a coil interlocked with a vibration of a washing tub and the like in addition to a core for varying an inductance of the coil with the water level of the washing water. That is, during the washing cycle and the rinsing cycle, the water level is detected by using a variation of the inductance of the coil caused by the movement of the core, and during the spinning cycle, the vibration is detected by using a variation of the inductance of the coil caused by movement of the vibration detecting means. This is possible because the water level detection is required mostly in the washing cycle and the rinsing cycle, and the vibration detection is required mostly in the spinning cycle. That is, in fact, the sensor for detecting both a water level and a vibration of the present invention serves as a water level detecting sensor in the washing cycle and the rinsing cycle, and as a vibration detecting sensor in the spinning cycle.

Figure 1:
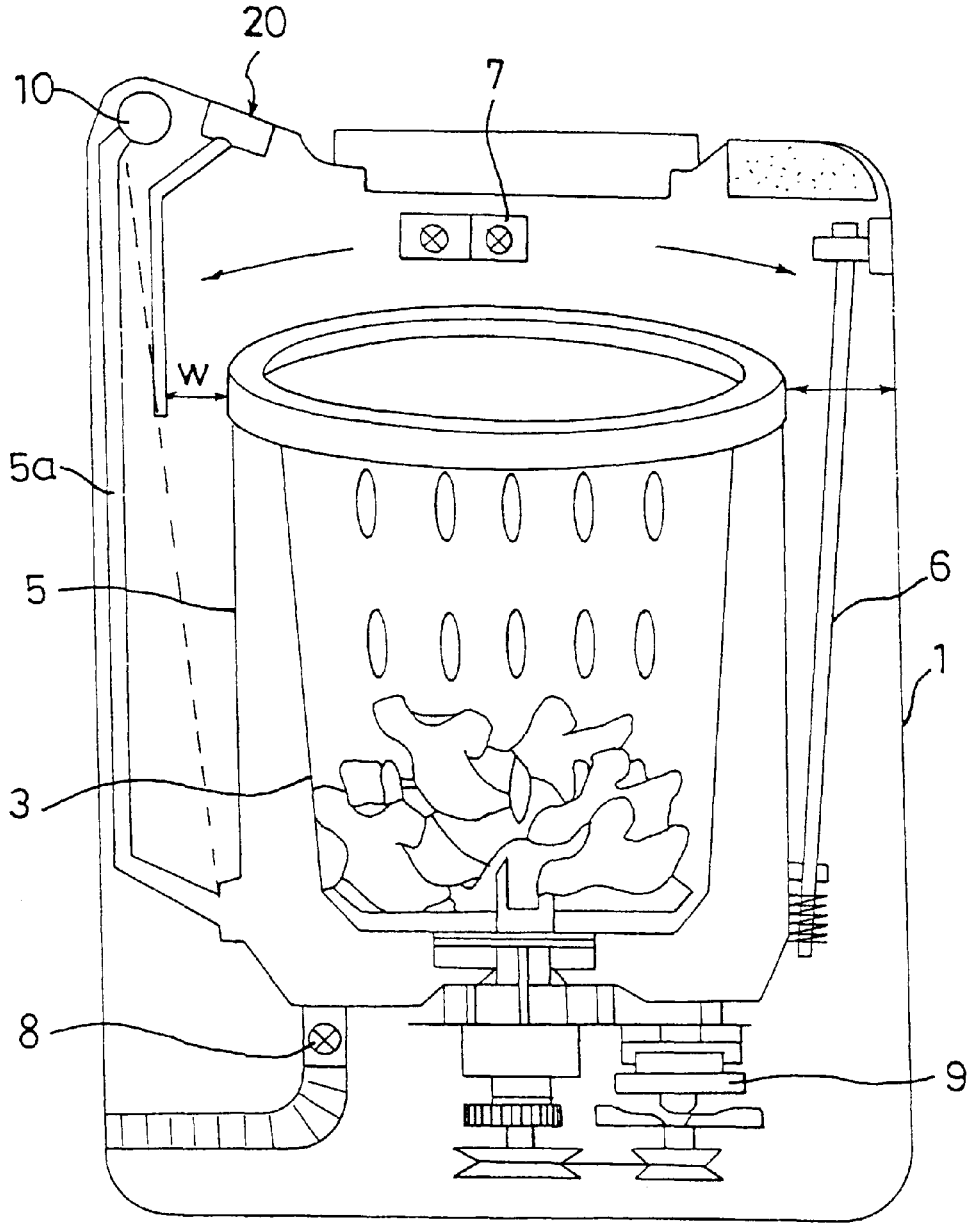
FIG. 1 Related Art
FIG. 1 illustrates a section of a washing machine having a related art water level detecting sensor and a vibration detecting sensor fitted thereto, schematically.
Figure 2A:
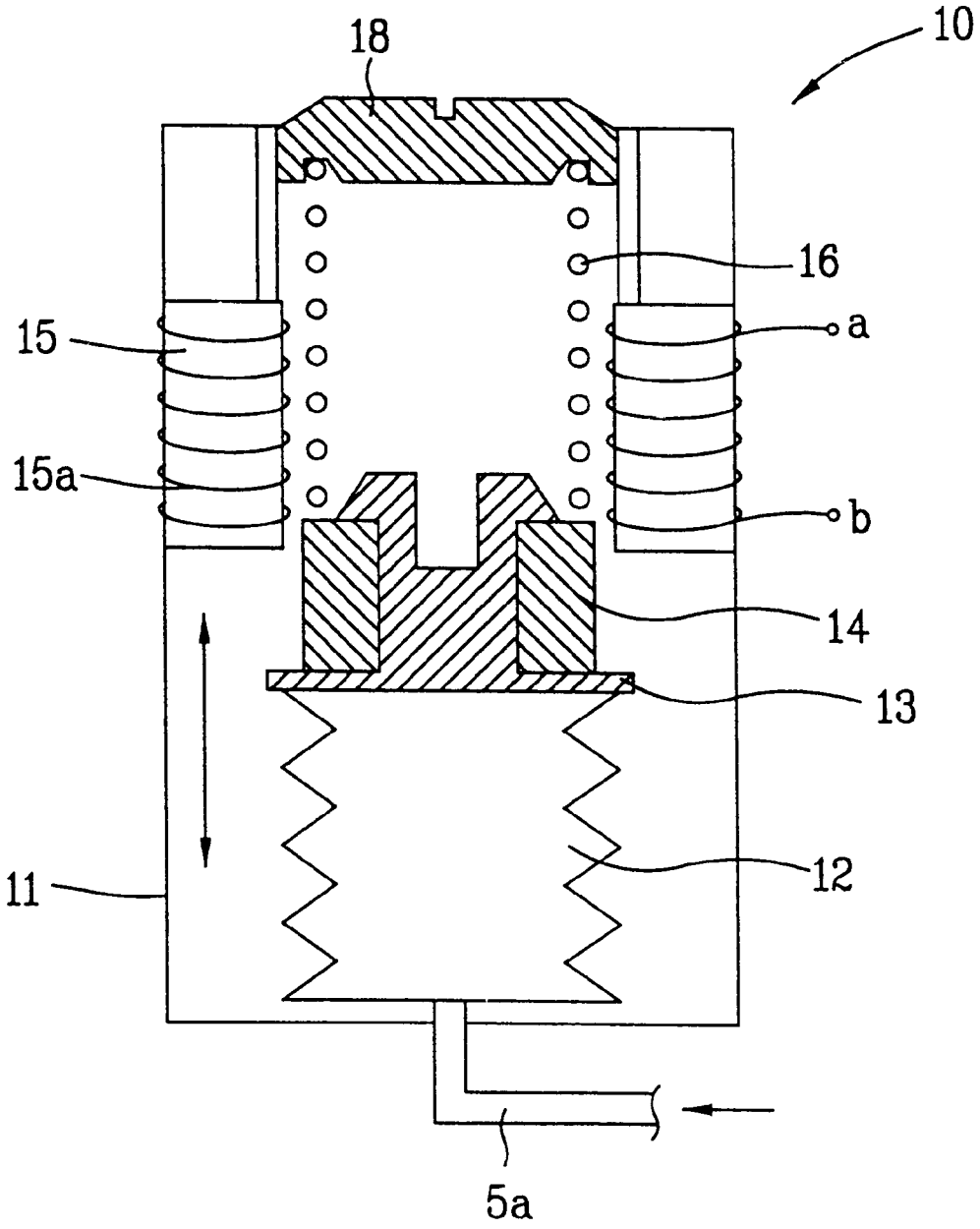
FIG. 2A Related Art
FIGS. 2A and 2B illustrate sections showing related art water level detecting sensors.
Figure 2B:
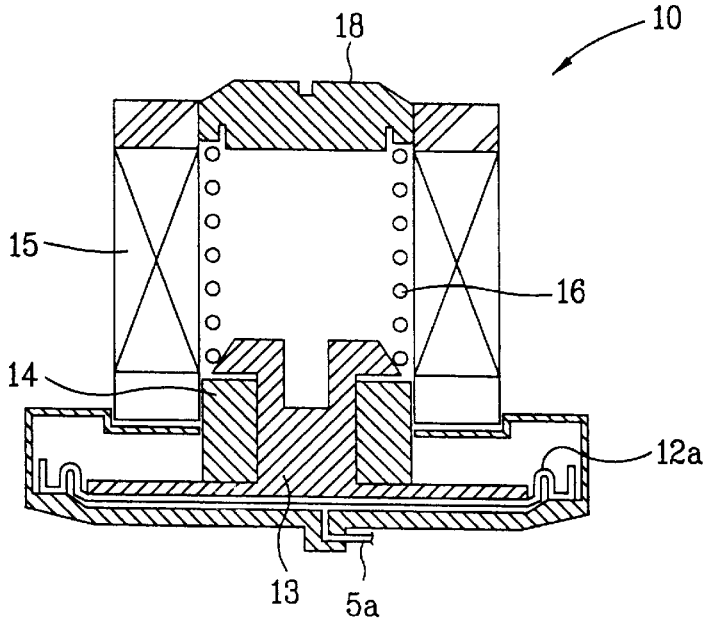
FIG. 2B Related Art
Figure 3:
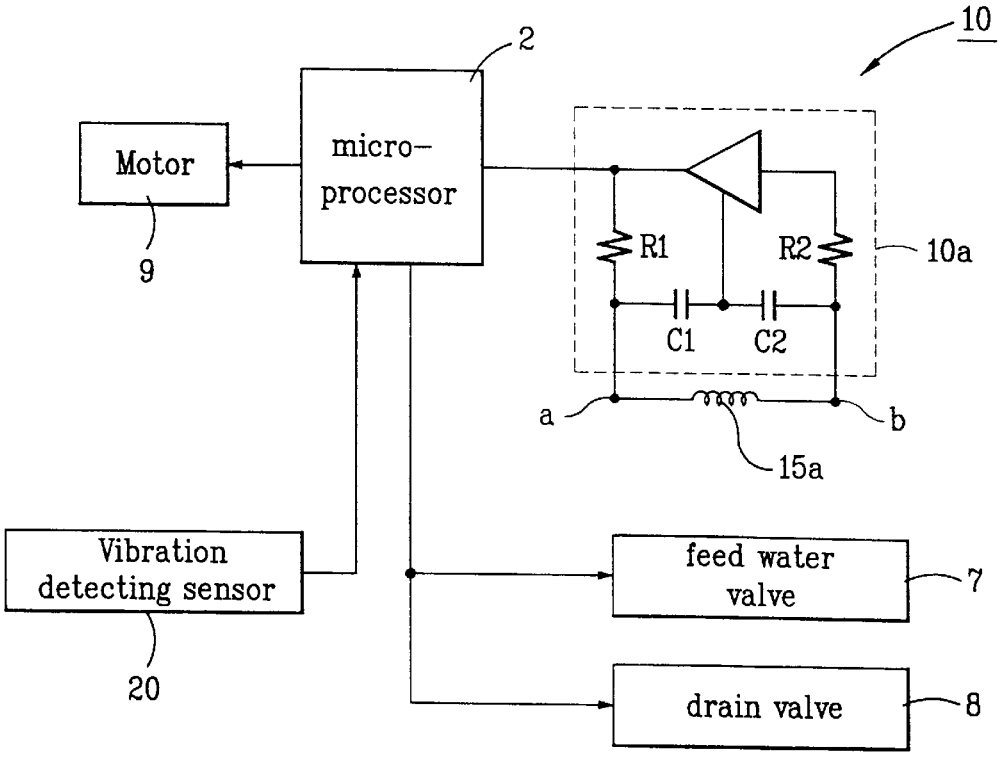
FIG. 3 illustrates a block diagram of the washing machine in FIG. 1.
Figure 4:
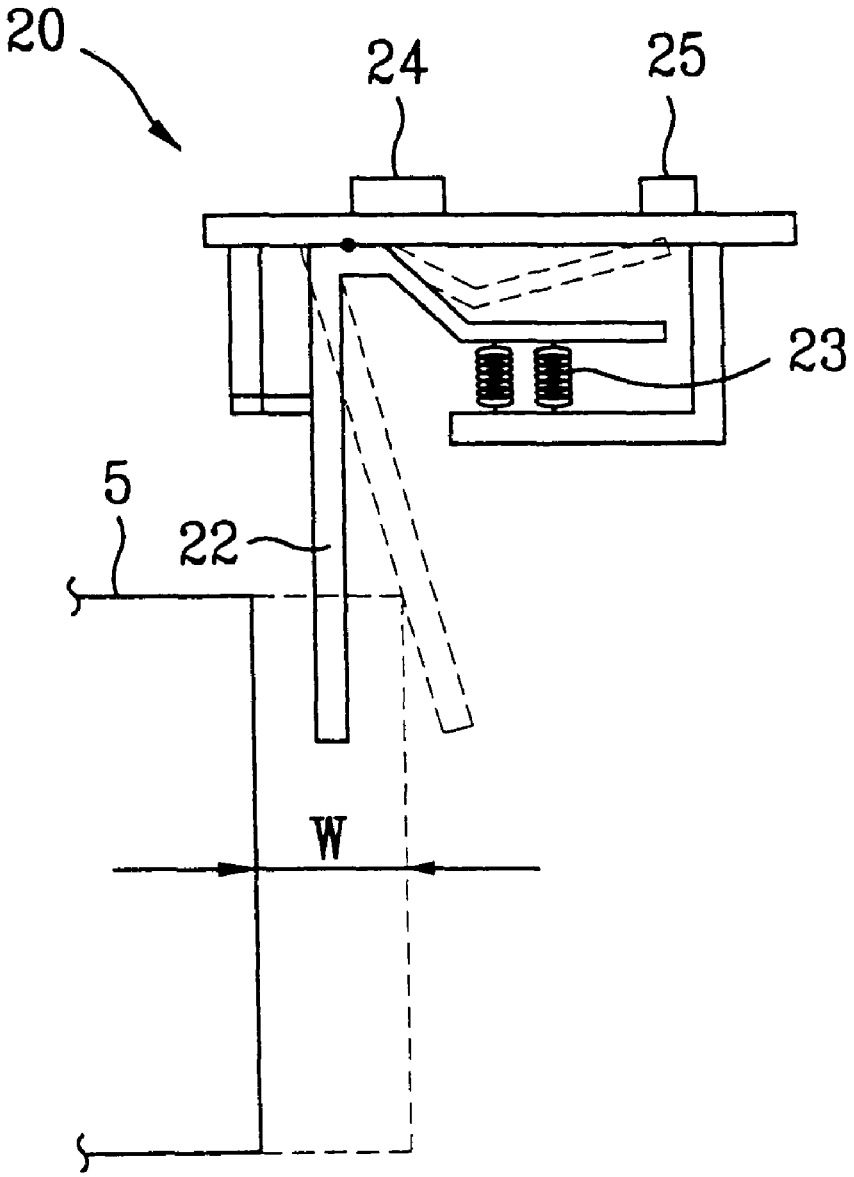
FIG. 4 Related Art
FIG. 4 illustrates a section showing a related art vibration detecting sensor, schematically.
Figure 5:
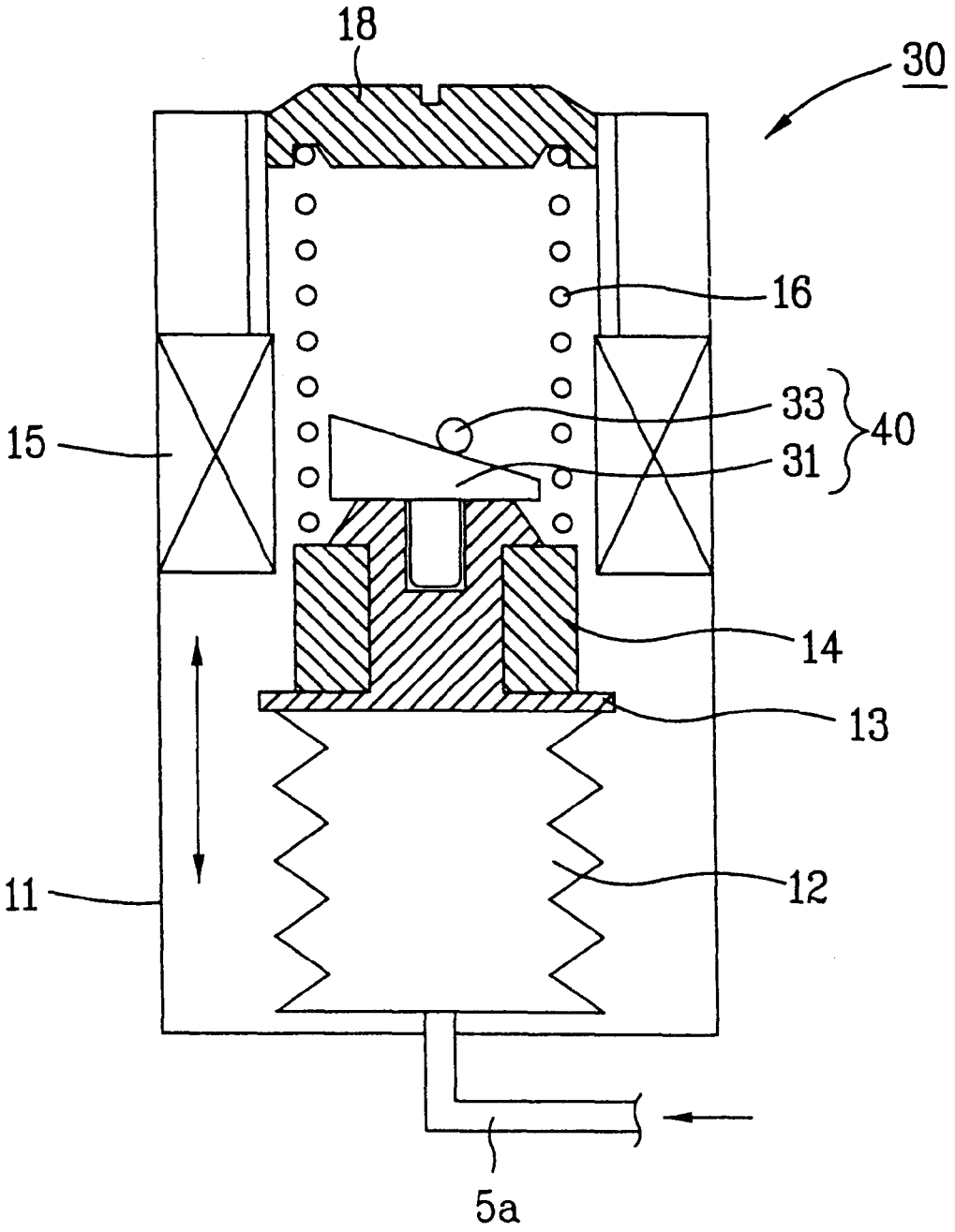
FIG. 5 illustrates a section of a sensor for detecting both a water level and a vibration in a washing machine in accordance with a first preferred embodiment of the present invention.
Figure 6:
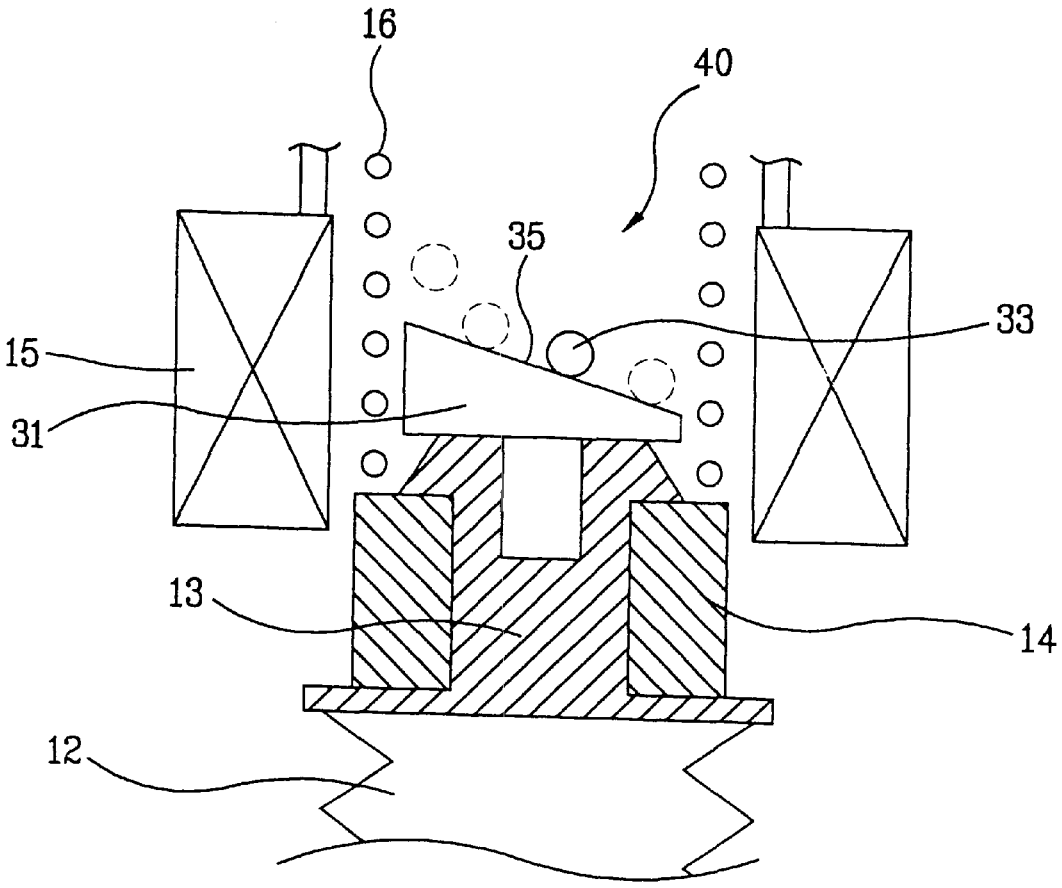
FIG. 6 illustrates a section showing an enlarged view of the vibration detecting means in FIG. 5.

The sensor for detecting both a water level and a vibration in a washing machine in accordance with a first preferred embodiment of the present invention will be explained with reference to FIGS. 5 and 6.

Similar to the related art, there are a coil part 15 having a coil, a core holder 13 for accommodating a core 14, hydraulic pressure transmission means, such as bellows 12 or a diaphragm 12*a*, a cap 18 and a spring 16, which are provided inside of a housing 11, a body of the sensor. In addition to this, the sensor of the present invention includes the vibration detecting means 40 for varying an inductance of the coil with movement caused by a vibration of the sensor itself disposed at a position of the sensor.

The vibration detecting means will be explained.

Figure 7:
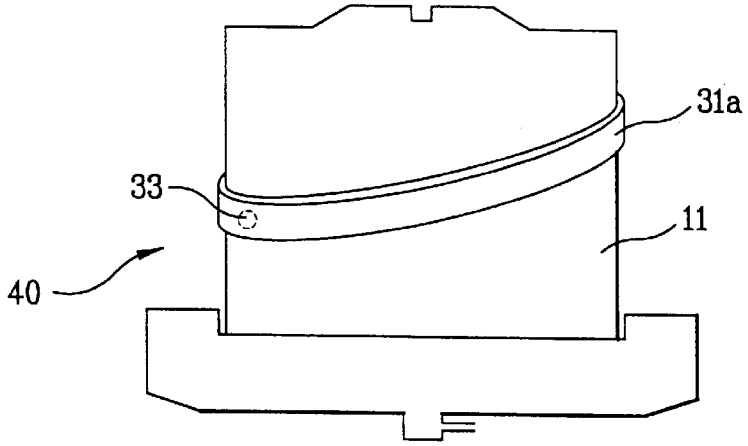
FIG. 7 illustrates a section of a sensor for detecting both a water level and a vibration in a washing machine in accordance with a second preferred embodiment of the present invention.
Figure 10:
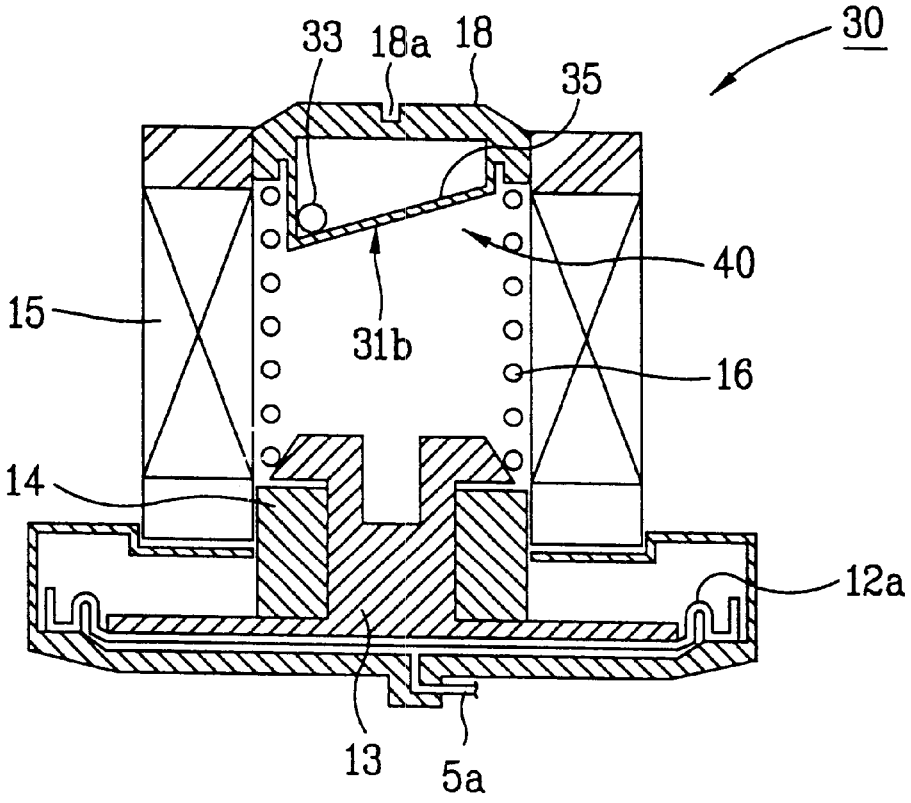
FIG. 10 illustrates a section of a sensor for detecting both a water level and a vibration in a washing machine in accordance with a third preferred embodiment of the present invention.

The vibration detecting means 40 includes rolling body 33 for moving in an up and down direction substantially interlocked with vibration of the washing tub to vary an inductance of a coil, and a rolling body supporting member 31 coupled to a top of a core holder 13 for accommodating the rolling body 33. The rolling body supporting member 31 has a sloped surface 35 having a slope with respect to a horizontal plane for causing the rolling body 33 to make an up and down movement substantially, and it is preferable that the rolling body 33 is formed of a magnetic material for varying the inductance of the coil as the rolling body 33 moves along the sloped surface 35. Though it is explained in this embodiment of the present invention that the vibration detecting means 40 is disposed on the top of the core holder 13, the present invention is not limited to this. That is, the vibration detecting means 40 may be disposed at any position as far as the position can vary the inductance of the coil by the movement of the rolling body 33. For example, as shown in FIG. 7, the vibration detecting means 40 may be disposed on an external surface of the core 14, i.e., on an external surface of the housing 11, or as shown in FIG. 10, to the cap 18.

Figure 8:
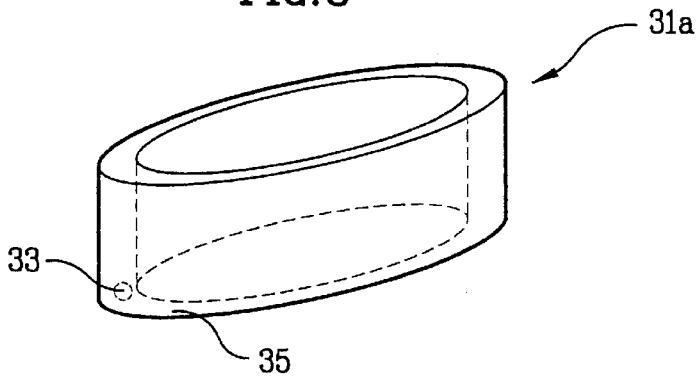
FIG. 8 illustrates a perspective view of the vibration detecting means in FIG. 7.
Figure 9:
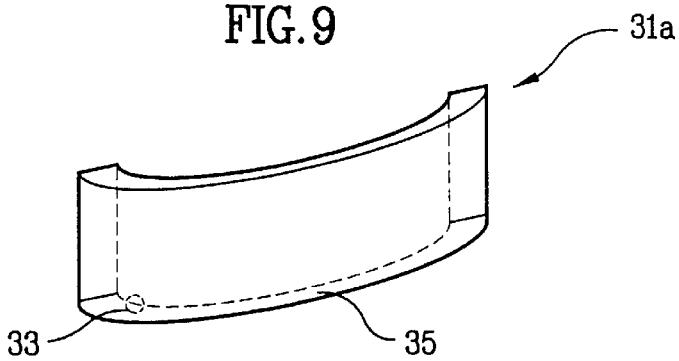
FIG. 9 illustrates a perspective view of an exemplary variation of the vibration detecting means in FIG. 7.

A case the vibration detecting means is disposed on the external surface of the housing will be explained, with reference to FIGS. 7 and 8. There is a rolling body supporting member 31*a* fitted to an external surface of the housing 11 disposed at an angle for accommodating the rolling body 33 therein. Preferably, the rolling body supporting member 31*a* has a top part which can be opened for inserting the rolling body 33 therein, and the sloped surface 35 of the rolling body supporting member 31*a* may be stepped, for limiting movement of the rolling body 33, appropriately. In the meantime, as shown in FIG. 9, the rolling body supporting member 31*a* may be formed on a portion of the housing 11. That is, the rolling body supporting member 31*a* may be formed on a portion of the housing 11 so that the rolling body 33 moves, not excessively, but within a limited distance in the rolling body supporting member 31*a*. In the meantime, it is explained in the foregoing embodiment that the rolling body supporting member 31*a* is fitted to the external surface of the housing 11, the present invention is not limited to this. That is, a space may be provided in the housing 11, for fitting the rolling body supporting member between an internal surface of the housing 11 and an external surface of the core 14.

Figure 11:
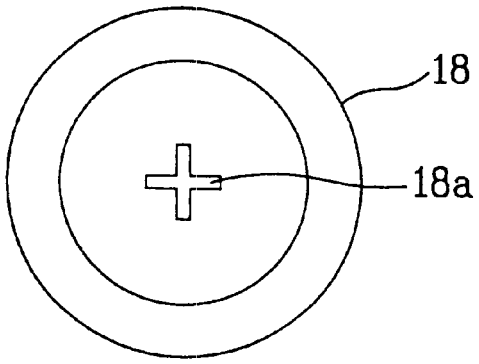
FIG. 11 is a plan view of the sensor in FIG. 10.
Figure 12A:
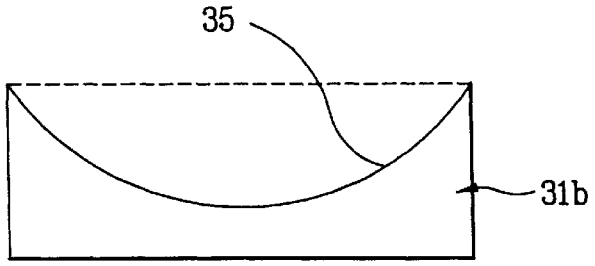
FIGS. 12A~12D illustrate sections of exemplary variations of the rolling body supporting member in FIG. 10.
Figure 12B:
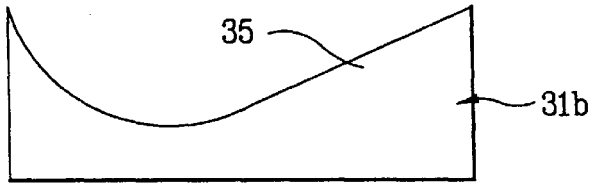
Figure 12C:
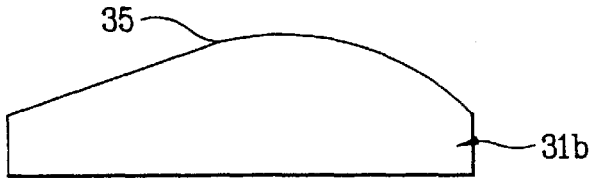
Figure 12D:
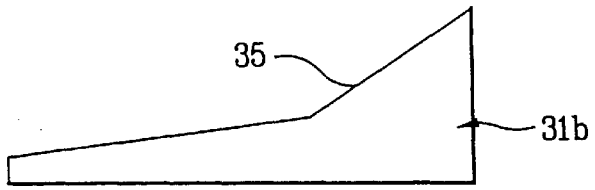

A case the vibration detecting means is disposed in the cap will be explained, with reference to FIGS. 10 and 11. There is a rolling body supporting member 31*b* beneath the cap 18 for accommodating the rolling body 33 for moving according to vibration of the washing tub. Of course, the rolling body supporting member 31*b* has a sloped surface having a slope. It is preferable that the cap 18 has an upper cap and a lower cap for easy insertion of the rolling body 33 in the rolling body supporting member 31*b*. And, it is preferable that the cap 18 has a threaded portion on an external surface, and a cross slot 18*a* in a top surface, for tightening or loosening the cap 18 as the case demands in adjusting the elastic force of the spring 16, appropriately. As shown in FIGS. 12A~12D, a variety of slope surfaces 35 of the cap 18 are possible. That is, as shown in FIG. 12A, the slope surface 35 may be concave, as shown in FIG. 12B, the slope surface 35 may be concave only in one side, as shown in FIG. 12C, the slope surface 35 may be convex at a center or only in one side, or as shown in FIG. 12D, the slope surface 35 may have a plurality of slope surfaces with different slopes. The slope surface of the rolling body supporting member may be determined taking a weight of the rolling body, a capacity of the washing machine, a spring constant of the spring, a number of turns of the coil, and the like into consideration.

The operation of the sensor for detecting both a water level and a vibration in a washing machine of the present invention will be explained with reference to FIGS. 13A~13D.

Figure 13A:
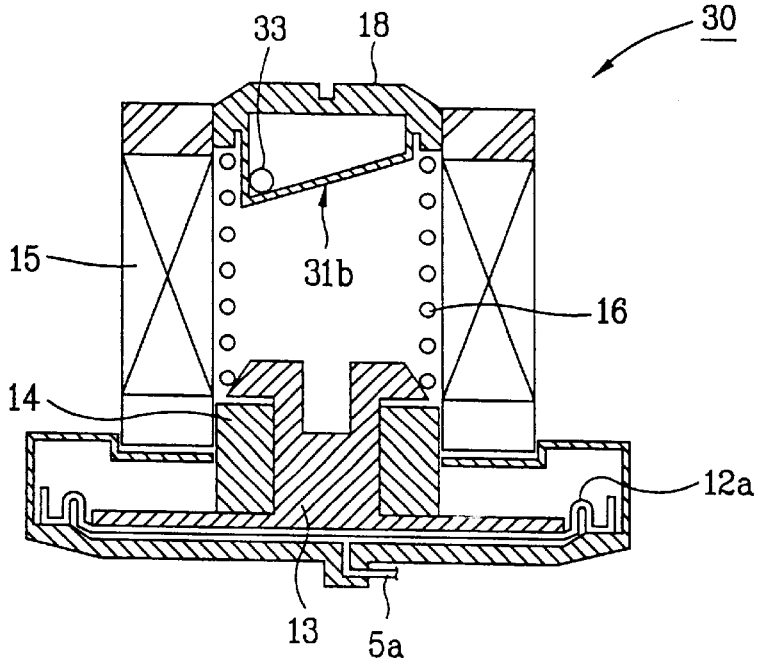
FIGS. 13A~13D illustrate sections showing operation states of the sensor in FIG. 10.
Figure 13B:
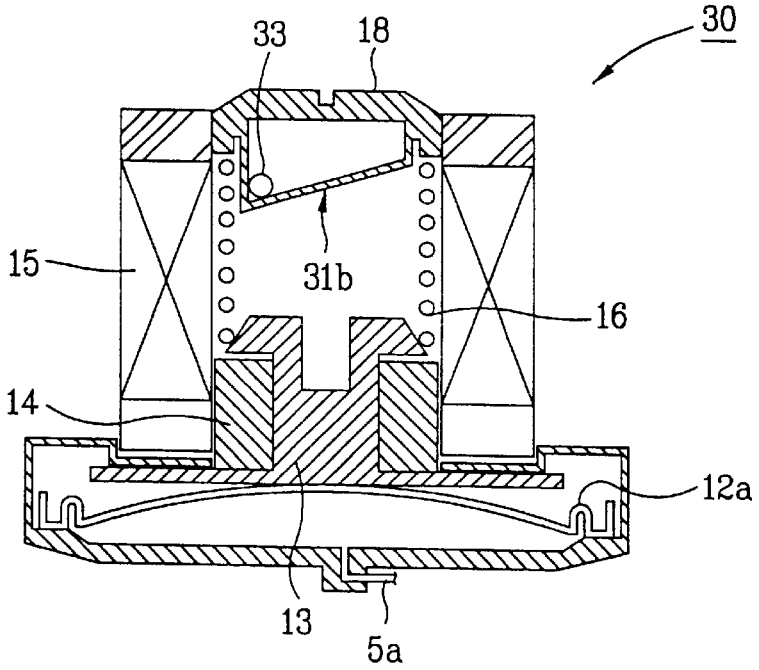
Figure 13C:
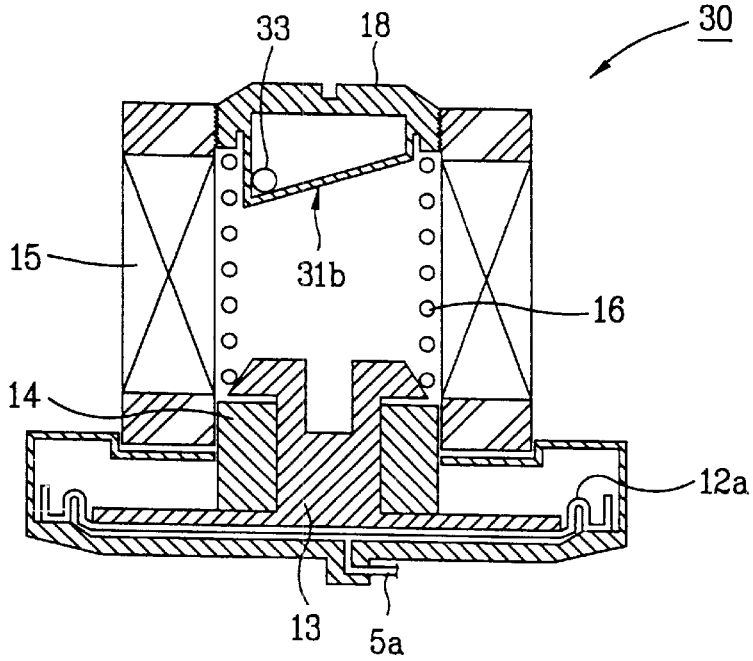
Figure 13D:
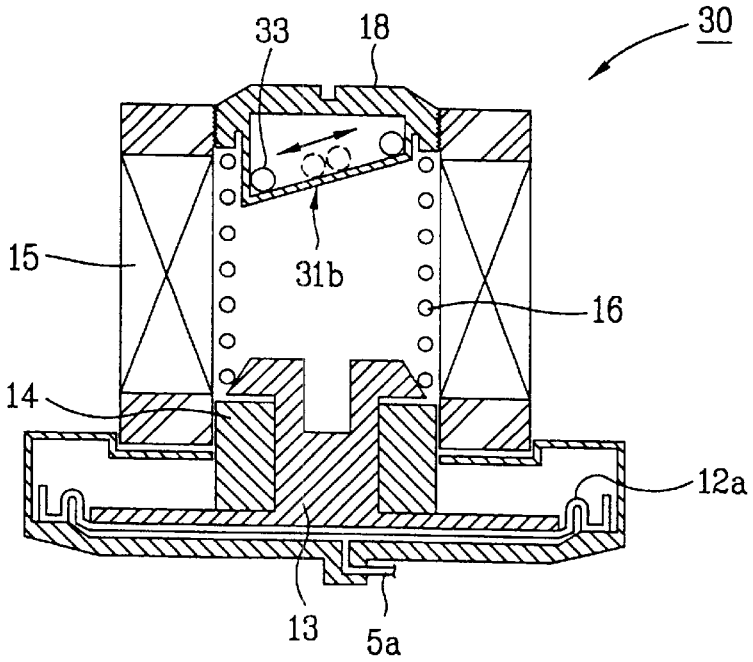

Referring to FIG. 13A, when there is no washing water in the washing tub, the sensor is in an initial state since there is no pressure on the diaphragm. According to this, as the core 14 is not inserted in the coil part 15, there is no change of the inductance of the coil. That is, a no existence of the washing water in the washing tub is determined from no change of the inductance of the coil. However, as shown in FIG. 13B, if water is supplied to the washing tub in the washing cycle or rinsing cycle, a pressure transmitted to the diaphragm 12*a* varies gradually, to expand the diaphragm upward. According to this, the core 14 on top of the diaphragm 12*a* also moves up into an inside space of the coil part 15, to change the inductance of the coil. That is, with reference to a variation of the inductance, the water level in the washing tub is determined, and once the detected water level reaches to a preset value, water supply is completed, and the pulsator is put into operation for conducting washing or rinsing. During the washing or rinsing cycle, since the rolling body 33 makes almost no movement, the inductance variation of the coil caused by the movement of the rolling body 33 is negligible because there is almost no vibration occurred as the washing tub or the pulsator is not rotated. Upon completion of the washing or rinsing cycle, the contaminated water in the washing tub is drained to outside of the washing machine. Then, as shown in FIG. 13C, the pressure on the diaphragm 12*a* is dropped gradually, and the diaphragm 12*a* and the core 14*a* return to the initial state by the elastic force of the spring 16. That is, if the inductance value becomes an initial inductance value of the coil, it is determined that the drain is completed. In the meantime, there is vibration occurred by spinning of the washing tub during the spinning cycle. And, the vibration of the washing tub is transmitted to the sensor as the sensor is connected to the outer tub. In this instance, not the core 14, but the rolling body 33 makes movement. Because there is no change to the diaphragm 12*a* as there is no washing water in the washing tub, but the rolling body 33 only moves due to vibration. When the vibration is transmitted to the sensor, the rolling body 33 moves along the sloped surface of the rolling body supporting member 31*b*. The movement of the rolling body 33 causes an inductance variation of the coil, which is measured as a level of the vibration. As explained, the sensor for detecting both a water level and a vibration in a washing machine permits detection both of the water level in the washing tub and the vibration of the washing tub by using one sensor, readily. Accordingly, the present invention permits reduction of, not only a production cost, but also assembly man-hours. In the meantime, in a case the vibration detecting means is mounted on top of the core holder, the vibration detecting means is fastened in general to the core holder by adhesive, which has the following disadvantage. The adhesive may be involved in degradation of an adhesiveness, to cause the vibration detecting means to fall off the core holder. And, a small adhesion area is not convenient for the assembly, and may cause the assembly defective, such that the vibration detecting means falls off the core holder.

Figure 14:
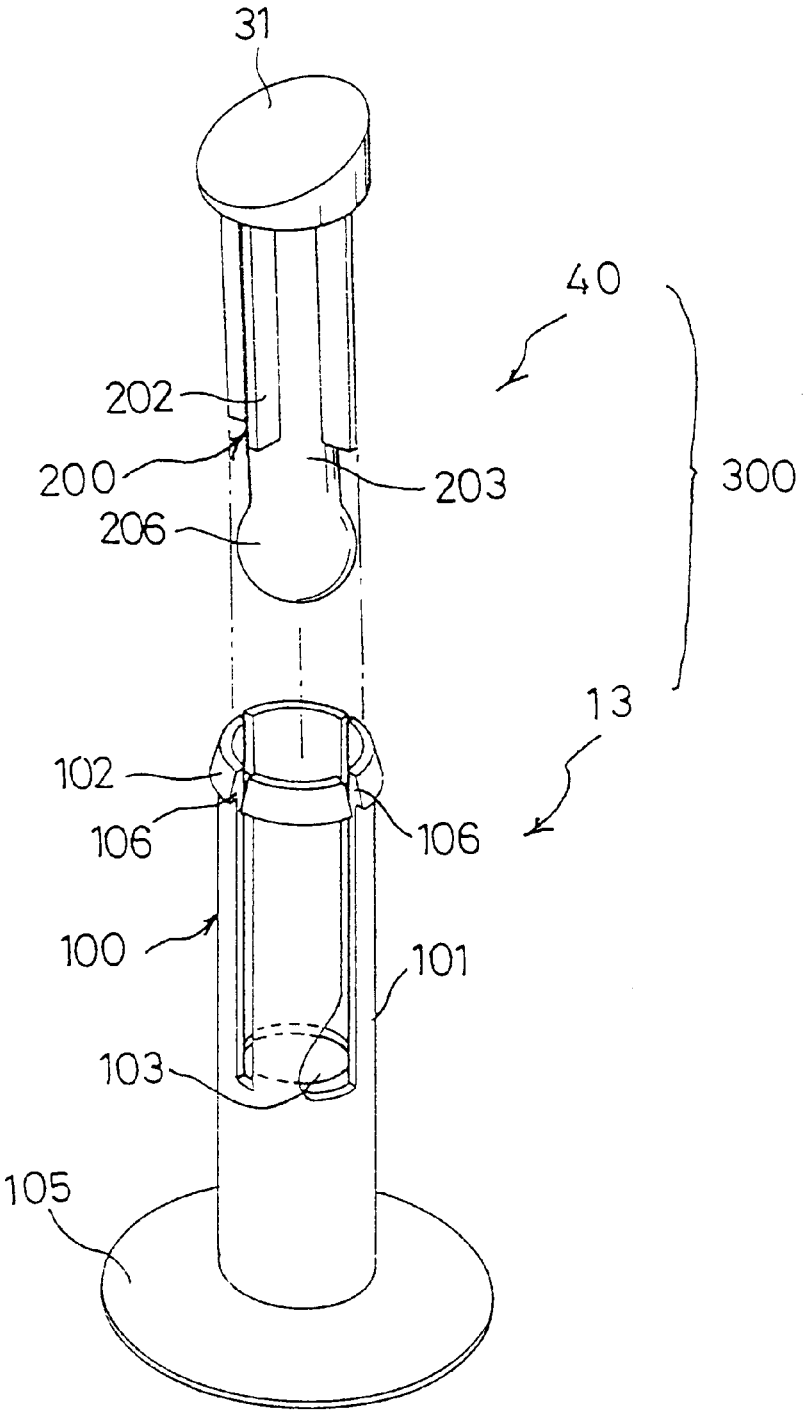
FIG. 14 illustrates a section of a sensor for detecting both a water level and a vibration in a washing machine in accordance with a fourth preferred embodiment of the present invention.
Figure 15:
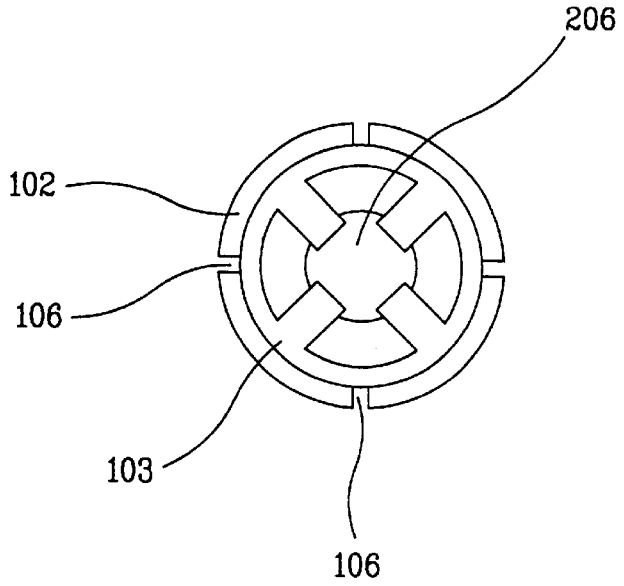
FIG. 15 illustrates a cross section of the sensor in FIG. 14 in an assembled state.
Figure 16:
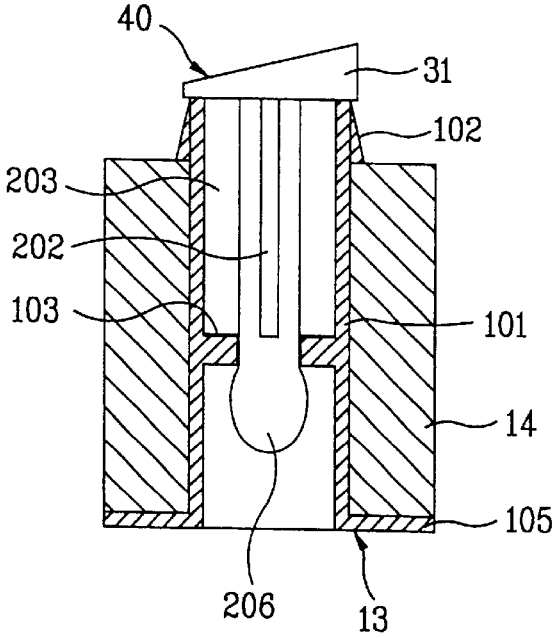
FIG. 16 illustrates a longitudinal section of the sensor in FIG. 14 in an assembled state.

A preferred embodiment, which is a modified version of the sensor shown in FIG. 5, will be explained, with reference to FIGS. 14~16.

Alike the foregoing embodiments, there is a core holder 13 on a diaphragm, and a vibration detecting means 40 is mounted on top of the core holder 13. However, different from the foregoing embodiments, the vibration detecting means 40 in this embodiment is, not fastened by adhesive, but detachably fastened by mechanical means. That is, the core holder 13 for accommodating the core 14 is disposed on a top surface of the pressure transmission means, such as bellows or diaphragm, and the vibration detecting means 40 is mounted on top of the core holder 13.

First, the vibration detecting means will be explained in detail.

The vibration detecting means 40 includes a rolling body supporting member 31 for accommodating the rolling body 33, and an inserting member 200 formed on a bottom of the rolling body supporting member 31 for insertion in, and fastening to the core holder 13. The inserting member 200 includes a body 203 formed vertical on the bottom of the rolling body supporting member 31, an inserting portion 206 at a fore end of the body 203 with a diameter larger than the body 203, and a plurality of vertical guide ribs 202 formed on an outside surface of the body 203. The guide ribs 202 are preferably formed at 90° intervals.

Next, the core holder 13 will be explained in detail.

The core holder 13 includes a supporting member 105 disposed on the diaphragm for receiving the pressure transmitted to the diaphragm, and a substantially cylindrical coupling member 100 formed vertical on a center of the supporting member 105 having an inside part for receiving, and coupling with the inserting member 200 of the vibration detecting means 40, and an outside surface for coupling with the core 14. The supporting member 105 is preferably formed thin and circular. The coupling member 100 has a plurality of vertical guide slots 106 at fixed intervals extended from a top portion to a middle portion for inserting the guide ribs 202 on the vibration detecting sensor, and a circular throat 103 on an inside wall of the middle portion for forced insertion of the inserting part 206 of the vibration detecting means 40. That is, an outside diameter of the body 203 of the vibration detecting means 40 should be smaller than an inside diameter of the coupling member 100 of the core holder 100, and an outside diameter of the inserting part 206 of the vibration detecting means 40 should be smaller than an inside diameter of the coupling member 100 of the core holder 13, but should be larger than an inside diameter of the circular throat 103. And, there are hook parts 102 at top ends of the coupling member 100 projected outward for coupling with the cylindrical core 14 between the hook parts 102 and a top surface of the supporting member 105. As shown in FIG. 14, it is preferable that the circular throat 103 on the inside wall of the core holder 13 is annular, but formation of the circular throat 103 with a plurality of ribs may also be acceptable.

A process for assembling the vibration detecting means and the core holder together will be explained.

First, upon bringing the guide ribs 202 on the vibration detecting means 40 to top of the guide slots 106 in the core holder 13 and pressing down the vibration detecting means 40, the inserting part 206 stops at the circular throat 103 formed on the inside wall of the core holder 13 once. Upon pressing further, the core holder 13 of an elastic material is expanded outward at the circular throat 103, to permit the insertion of the inserting part 206 further down, thereby coupling the vibration detecting means 40 to the core holder 13. In this instance, the guide slots 106 in the core holder 13 helps assembly of the vibration detecting means 40 to the core holder 13 as the guide slots 106 in the core holder 13 helps the core holder 13 to open apart outwardly. And, upon completion of the insertion of the inserting part 206, the core holder 13 returns to an original state as the core holder 13 is formed of an elastic material. That is, once the assembly is completed, the inserting part 206 can not naturally come out of the circular throat 103. The firm mechanical coupling of the vibration detecting means 40 with the core holder 13 ensures a strong coupling between them, and effectively prevents the vibration detecting means 40 from being fallen off the core holder 13 due to moisture and heat in a prolonged use of the washing machine.

Figure 17:
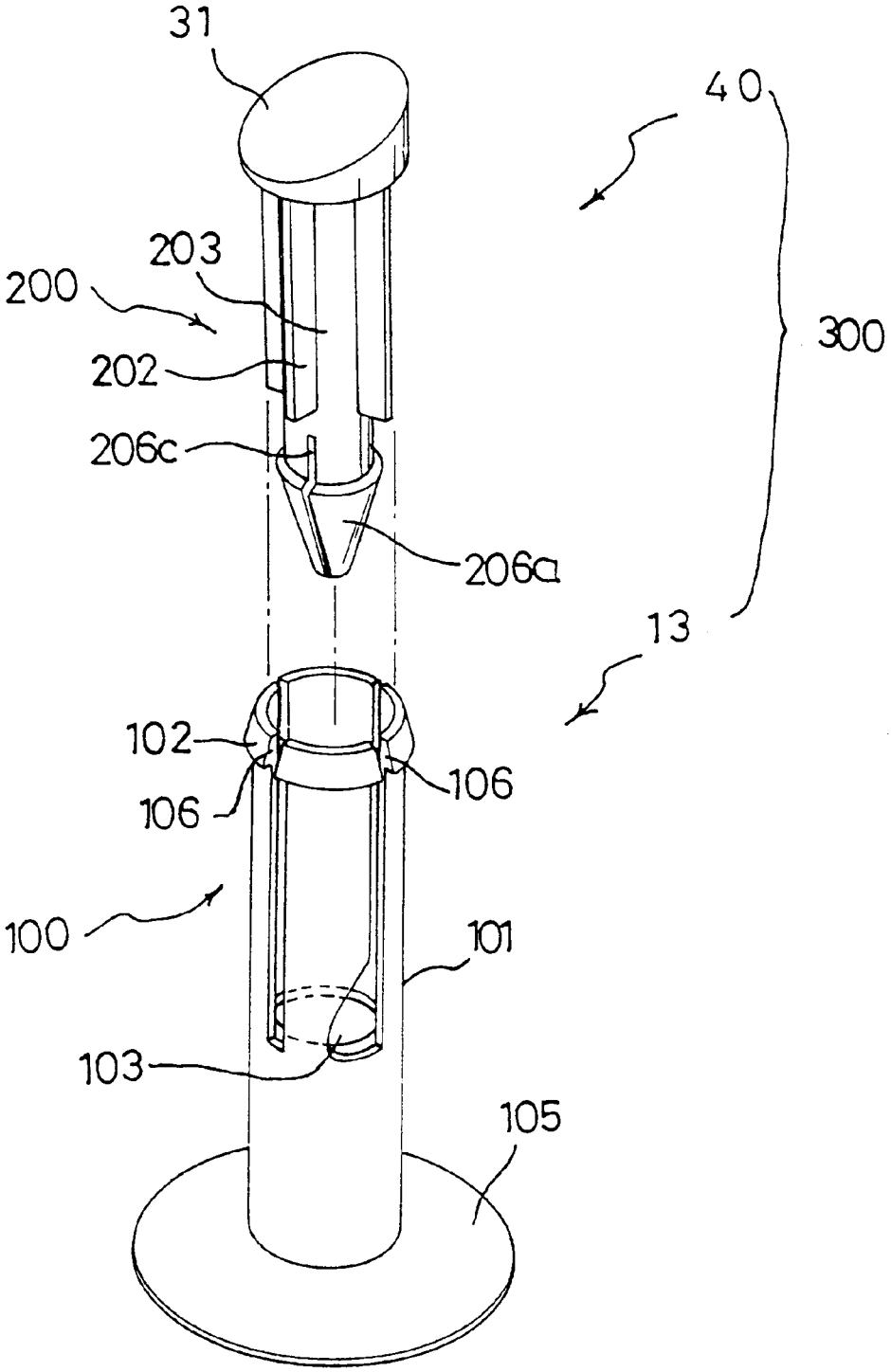
FIG. 17 illustrates a disassembled perspective view of an exemplary variation of the sensor in FIG. 14.
Figure 18:
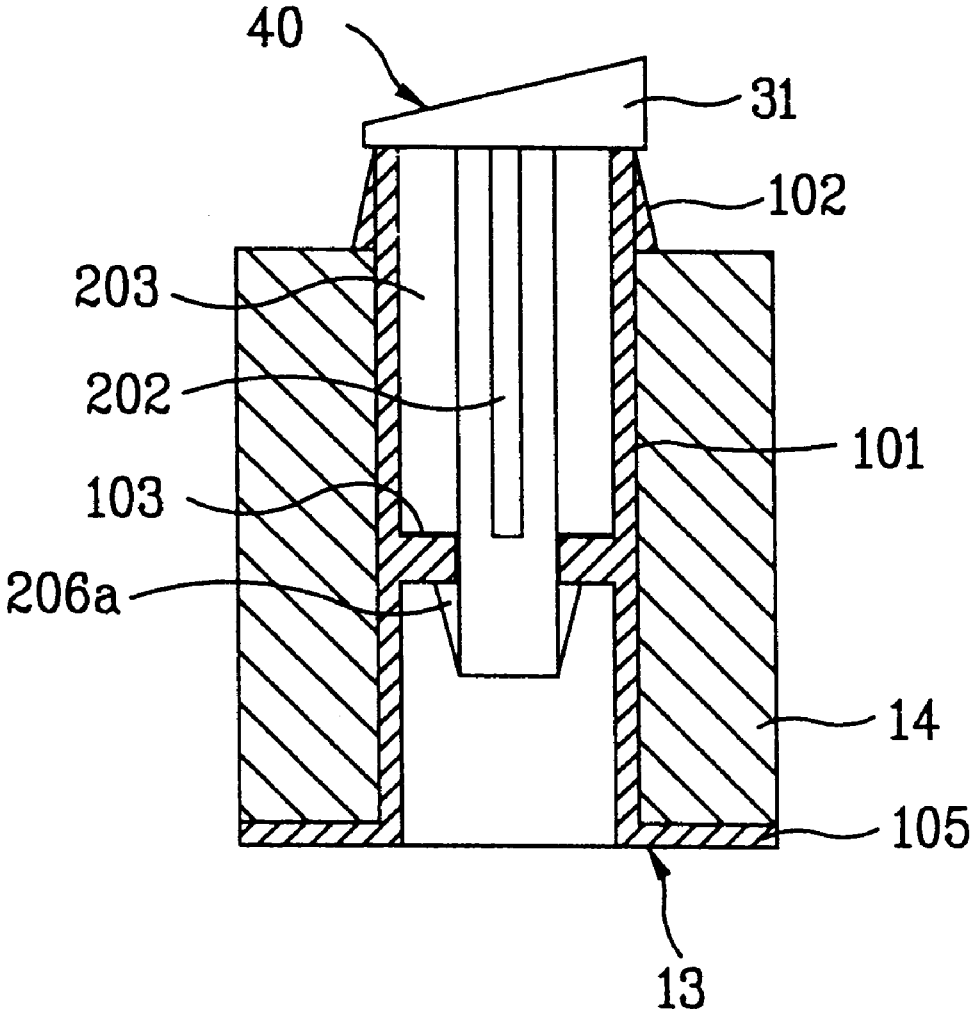
FIG. 18 illustrates a longitudinal section of an exemplary variation of the sensor in FIG. 17 in an assembled state.

An exemplary variation of the foregoing embodiment will be explained with reference to FIGS. 17 and 18. This exemplary variation has an identical structure to the foregoing embodiment except the inserting part 206 of the vibration detecting means 40. That is, though the inserting part 206 in the foregoing embodiment is substantially spherical or oval, with a diameter greater than the body 203. However, the exemplary variation modified the shape for simpler and stronger assembly. In detail, the inserting part 206*a* is conical, i.e., has a diameter reduced as it goes down, with a top part diameter greater than an inside diameter of the circular throat in the core holder 13. And, preferably, the inserting part has a plurality of deep slots 206*c*. This structure permits an easy assembly of the vibration detecting means 40 to the core holder 13 as an external surface of the conical inserting part 206*a* slides on the circular throat 103 when the inserting part 206*a* is inserted through the circular throat 103, and ensures a stronger coupling as the inserting part 206*a* is difficult to come out of the circular throat 103 once the assembly is completed.

Figure 19A:
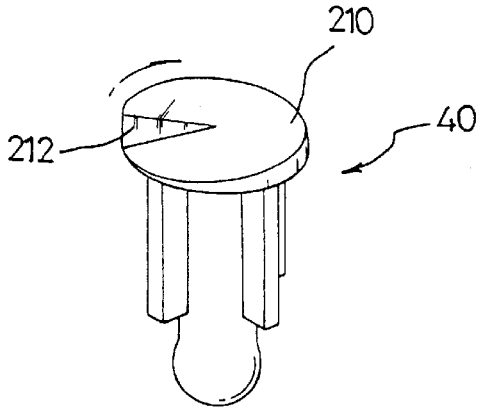
FIGS. 19A and 19B respectively illustrate perspective view and a side view of a sensor for detecting both a water level and a vibration in a washing machine in accordance with a fifth preferred embodiment of the present invention; and, FIG. 20 illustrates a perspective view of an exemplary variation of the sensor in FIG. 19A.
Figure 19B:
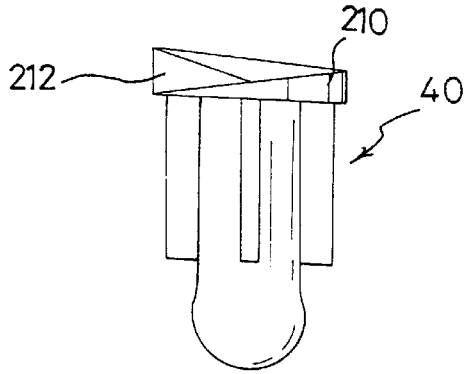
Figure 20:
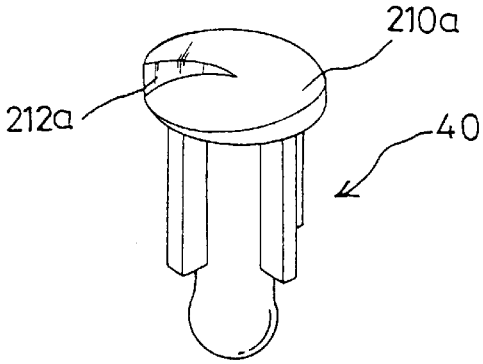

A preferred embodiment of the rolling body supporting member in the vibration detecting sensor of the present invention will be explained, with reference to FIGS. 19A and 19B, provided for preventing malfunction of the sensor coming from sensitive movement of the rolling body 33 even to a small vibration during the spinning cycle. In detail, the slope surface 210 of the rolling body supporting member 210 has a radial barring surface 212 substantially vertical to the slope surface 210, started from a center of the slope surface 210 in the radial direction to form a helical slope surface 210 started from an upper side of the barring surface 212 to a lower surface of the barring surface 212 in a direction the same with a direction of rotation of the washing tub(shown in an arrow on the drawing) for preventing rotation of the rolling body in a direction the same with a direction of rotation of the washing tub in the spinning cycle. The barring surface 212 in FIG. 19 is applicable when the direction of spinning is clockwise on the drawing. If the direction of spinning is counter clockwise, the barring surface 212 should be formed oppositely. According to this, a minute vibration in the spinning cycle can not move the rolling body 212 toward an upper side of the slope surface 210 because the rolling body 212 can not overcome the barring surface 212. However, a large amplitude vibration permits the rolling body to overcome the barring surface 212 to cause a change of the coil inductance, that is detected as a vibration. At the end, as the rolling body makes no rotation when the vibration is small and makes rotation when the vibration is great coming from imbalance of the laundry and the like, the rolling body of the present invention permits an accurate detection of the vibration. In the meantime, the slope surface may be divided into two or more than two regions with different angles. Though the barring surface 212*a* is in general formed of straight lines, the barring surface 212*a* may be formed of curved surface as shown in FIG. 20.

The sensor for detecting both a water level and a vibration in a washing machine of the present invention has the following advantages.

First, the detection both of a water level and a vibration by using one sensor can save a production cost and assembly man-hour of a washing machine.

Second, accurate vibration sensing is made available in comparison to the related art vibration sensor.

Third, reliabilities of the vibration and the water level detection can be ensured even in a prolonged use of the washing machine since the sensor of the present invention is not influenced from heat or moisture.

In conclusion, the sensor of the present invention can prevent an occurrence of error in detection of vibration and subsequent prolonged spinning time period, which have been occurred in the related art washing machine effectively because the vibration of the washing machine can be detected more accurately.

It will be apparent to those skilled in the art that various modifications and variations can be made in the sensor for detecting both a water level and a vibration in a washing machine of the present invention without departing from the spirit or scope of the invention. Thus, it is intended that the present invention cover the modifications and variations of this invention provided they come within the scope of the appended claims and their equivalents.

What is claimed is:

1. A sensor for detecting both a water level and a vibration in a washing machine comprising:

a housing which is a body of the sensor for detecting both the water level and the vibration;

hydraulic pressure transmission means under the housing for moving up and down by a hydraulic pressure of the water level in a washing tub;

a coil part above the hydraulic pressure transmission means having a coil with a proper inductance;

a core holder on the hydraulic pressure transmission means having a core accommodated therein, the core adapted to move up and down within the coil part for varying the inductance of the coil;

a cap fitted to a top portion of the coil part;

a spring placed in a hollow of the coil part; and, a vibration detecting means adapted to move according to the vibration of the housing for varying the inductance of the coil, whereby detecting the water level in the washing tub by substantially varying the inductance of the coil with the up and down movement of the core during a washing cycle or a rinsing cycle, and substantially detecting the vibration of the washing tub by varying the inductance of the coil by means of the vibration detecting means during a spinning cycle.

2. A sensor as claimed in claim 1, wherein the vibration detecting means includes;

a rolling body for substantially moving up and down interlocked with the vibration of the washing tub for varying the inductance of the coil, and a rolling body supporting member having a sloped surface with an angle for accommodating the rolling body.

3. A sensor as claimed in claim 2, wherein the vibration detecting means is fitted to a top of the core holder.

4. A sensor as claimed in claim 3, wherein the rolling body supporting member includes an inserting member on a bottom, and the core holder includes a coupling member for mechanically inserting and coupling the inserting member thereto.

5. A sensor as claimed in claim 4, wherein the coupling member includes a plurality of guide slots in an outside surface in an axis direction, and a circular throat on an inside wall projected inward from a lower portion, and the inserting member includes a body having a diameter smaller than an inside diameter of the coupling member, a plurality of guide ribs on an outside surface of the body for being guided by the guide slots, and an inserting part at an end of the body having a diameter smaller than an inside diameter of the coupling member and greater than an inside diameter of the circular throat.

6. A sensor as claimed in claim 5, wherein the inserting part is spherical, oval or conical.

7. A sensor as claimed in claim 2, wherein the vibration detecting means is fitted to an external side surface of the coil part.

8. A sensor as claimed in claim 2, wherein the vibration detecting means is fitted to an inside of the cap.

9. A sensor as claimed in claim 2, wherein the slope surface of the rolling body supporting member includes a barring surface substantially vertical to the slope surface for inhibiting movement of the rolling body for a minute vibration.

10. A sensor as claimed in claim 9, wherein the barring surface is formed in an radial direction starting from a center of the slope surface toward the outside diameter, and the slope surface is helical.

* * * * *